US007234858B2

(12) United States Patent
Meier

(10) Patent No.: US 7,234,858 B2
(45) Date of Patent: Jun. 26, 2007

(54) WATCH CASE

(75) Inventor: Willy Meier, Fontaines (CH)

(73) Assignee: Eterna SA, Grenchen (CH)

( * ) Notice: Subject to any disclaimer, the term of this patent is extended or adjusted under 35 U.S.C. 154(b) by 224 days.

(21) Appl. No.: 10/535,535

(22) PCT Filed: Nov. 13, 2003

(86) PCT No.: PCT/CH03/00745

§ 371 (c)(1),
(2), (4) Date: May 18, 2005

(87) PCT Pub. No.: WO2004/046831

PCT Pub. Date: Jun. 3, 2004

(65) Prior Publication Data

US 2006/0002242 A1 Jan. 5, 2006

(30) Foreign Application Priority Data

Nov. 18, 2002 (EP) ..... 02405993

(51) Int. Cl.
*G04B 37/00* (2006.01)
*G04B 39/00* (2006.01)

(52) U.S. Cl. ..... 368/291; 368/294

(58) Field of Classification Search ..... 368/88, 368/286, 287, 291, 294–295
See application file for complete search history.

(56) References Cited

U.S. PATENT DOCUMENTS 4,234,948 A * 11/1980 Maekawa et al. ..... 368/291
4,456,388 A * 6/1984 Matsumoto ..... 368/294
5,521,889 A * 5/1996 Scarinzi et al. ..... 368/294
2002/0021624 A1* 2/2002 Hiranuma et al. ..... 368/282

* cited by examiner

*Primary Examiner*—Vit W. Miska
(74) *Attorney, Agent, or Firm*—Townsend M. Belser, Jr.; Nexsen Pruet Adams Kleemeier, LLC

(57) ABSTRACT

The invention relates to a watch case comprising a case middle (16), a bezel (18) mounted so that it can turn on the middle and defining between them an annular chamber (36) and a gap (40) open towards the outside of the case, a glass (22) mounted in sealed fashion on the bezel, a seal (42) inserted between the bezel and the middle and arranged in said chamber (36). According to the invention said seal comprises a ring (44) of annular shape made of a material of the highly elastically deformable type, of annular shape, and the cross section of which comprises two lips (44*a*), one bearing against the bezel (18), the other against the case middle (16), and a compression member (48) arranged in said chamber on the side of the gap, inserted between and collaborating with said lips in order to compress them against the bezel and against the case middle, respectively.

16 Claims, 5 Drawing Sheets

50:1

WATCH CASE

Figure 1:
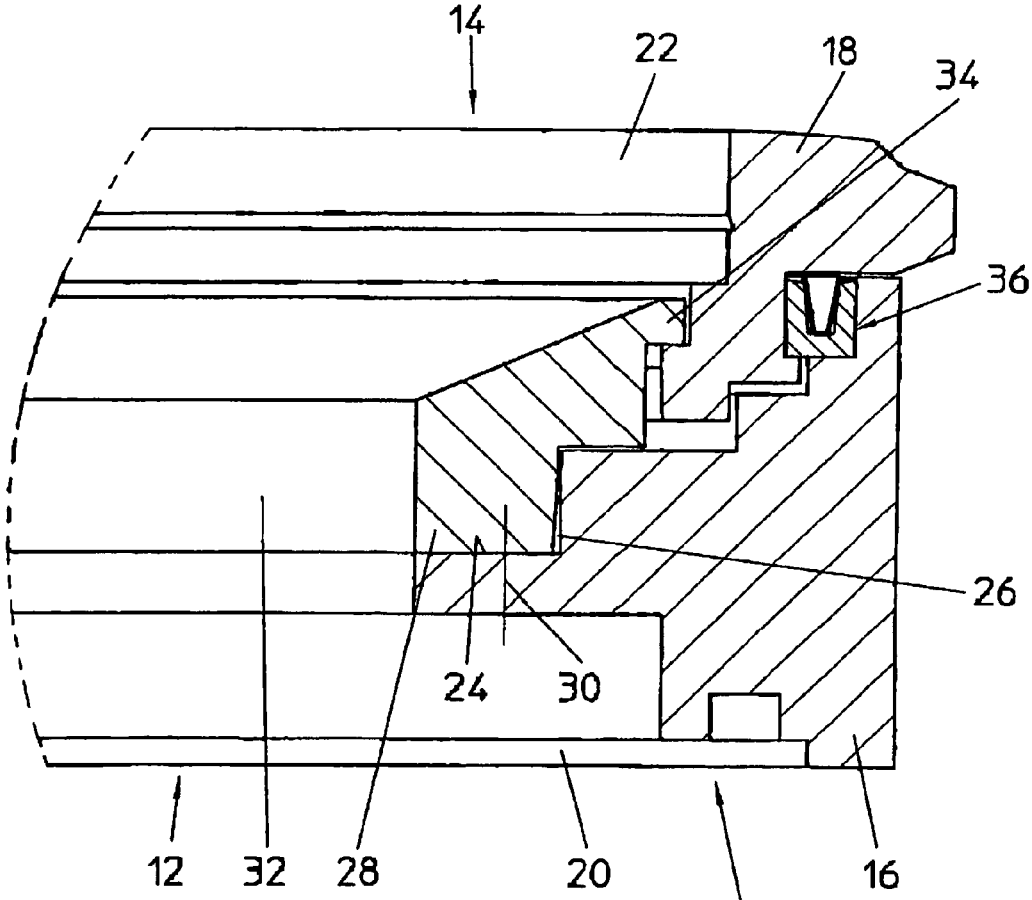

The invention relates to the field of sealed watch cases. It relates more particularly to a case provided with a rotary bezel, of the type often used in subsea diving watches. The rotary bezel allows a mark to be brought to face the hands, especially to define a maximum dive time.

Obviously, watches intended to be immersed in water need to be equipped with a sealed case. This quality is obtained by virtue of the presence of seals arranged between the constituent parts of the watch case, namely: the bezel, the case middle, the case back and the glass which thus, together, form a housing protecting the movement.

In watches equipped with a rotary bezel the latter is often arranged on the case middle, around the glass, but entirely outside the housing. The bezel can thus turn freely, but is a relative distance away from the hands. The indications it bears can sometimes not be clearly visible. In addition, as they are not protected, their legibility may deteriorate over time.

In order to alleviate this drawback it has been proposed to produce a case in which the bezel carries the glass and is mounted to turn on the middle, with the interposition of an O-ring seal.

Unfortunately, because the seals used have a very large ratio relating their perimeter and the diameter of their cross section, local deformations may be generated as the bezel is turned. As a result, the quality of the contact between the seal and the walls of the middle and of the bezel is lessened and the sealing may be affected.

In addition, it is problematical to have a seal that allows the bezel to be rotated easily at a pressure close to atmospheric pressure while at the same time remaining sealed at great depths.

It is an object of the present invention to alleviate these drawbacks by providing a watch case equipped with a rotary bezel that can be turned with ease and whose sealing remains good, even at high pressure.

More specifically, the invention relates to a watch case comprising a case middle, a bezel mounted so that it can turn on the middle and defining between them an annular chamber and a gap open towards the outside of the case, a glass mounted in sealed fashion on the bezel, a seal inserted between the bezel and the middle and arranged in said chamber.

According to the invention, the seal comprises:

- a ring of annular shape made of a material of the highly elastically deformable type and the cross section of which comprises two lips, one bearing against the bezel, the other against the case middle; and
- a compression member arranged in said chamber on the side of the gap, inserted between and collaborating with the lips in order to compress them against the bezel and against the case middle, respectively.

The lips are connected to one another by an intermediate part. They are arranged in such a way as to form an acute angle between them. The chamber is defined by lateral, upper and lower walls. The lips have, at their free end, a contact surface intended to bear against the lateral walls of the chamber, while the intermediate part is flat and hugs the lower wall of the chamber. For sealing to be ensured it is necessary for the gap not to be filled.

The compression member comprises an annular spring placed directly in contact with the lips. Advantageously, this spring has regular wave forms distributed on either side of a circle of a diameter more or less equal to the mean diameter of the chamber, the wave forms being bent about the line formed by the mean circle, the angle of the bend being slightly greater than or equal to the angle formed by said lips. This spring may advantageously be made of stainless steel.

The compression member may furthermore comprise a positioning ring inserted between the spring and one of the walls of the chamber. It is advantageously arranged facing the bezel and comprises positioning studs resting against it in such a way as to keep the intermediate part bearing against a wall of the chamber.

The invention also relates to a seal for a watch. Advantageously, it comprises a ring of annular shape made of a material of the highly elastically deformable type, the cross section of which comprises two lips, and a compression member arranged between the lips and collaborating with them in order to compress them. The compression member comprises an annular spring placed directly in contact with the lips and a positioning ring collaborating with the spring in order to hold it in place.

Figure 2A:
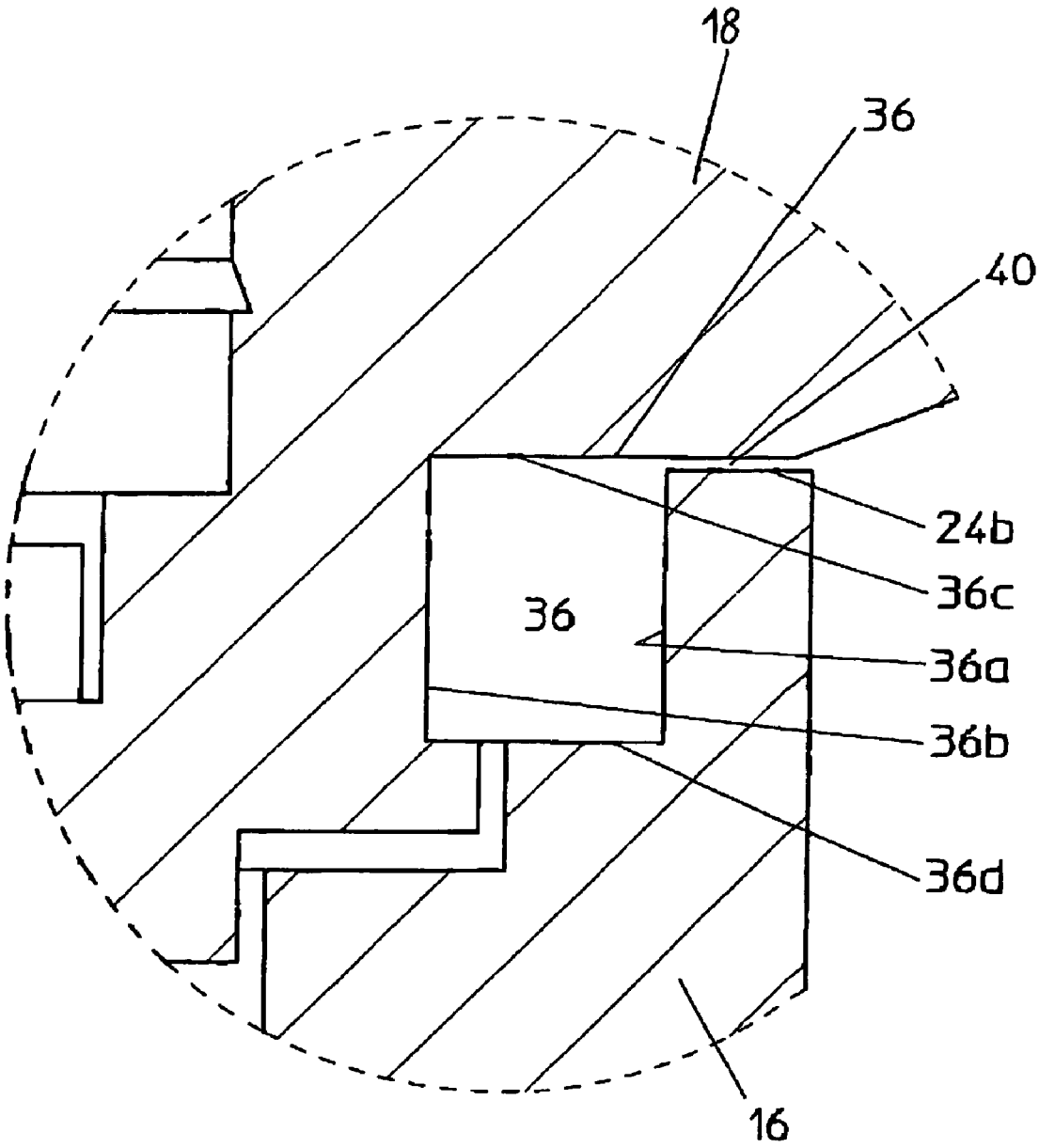
Figure 2B:
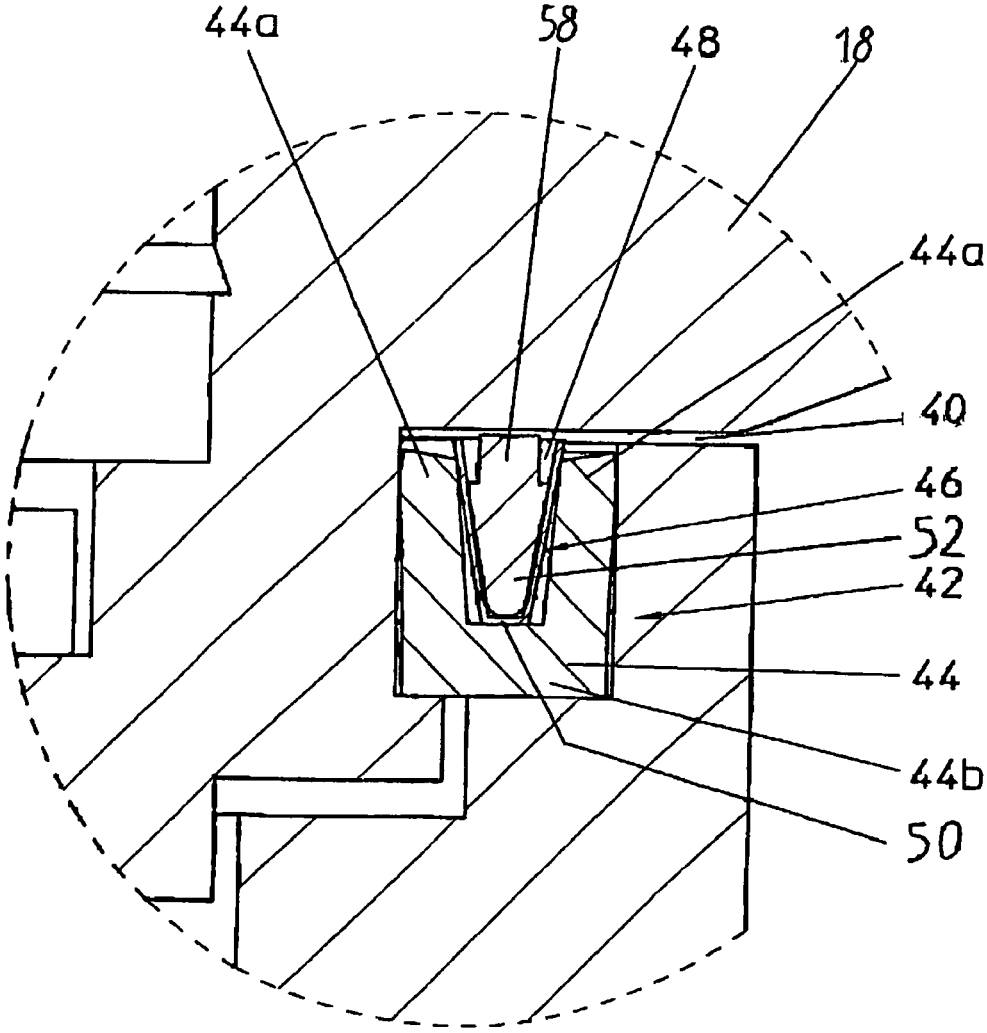
Figure 3:
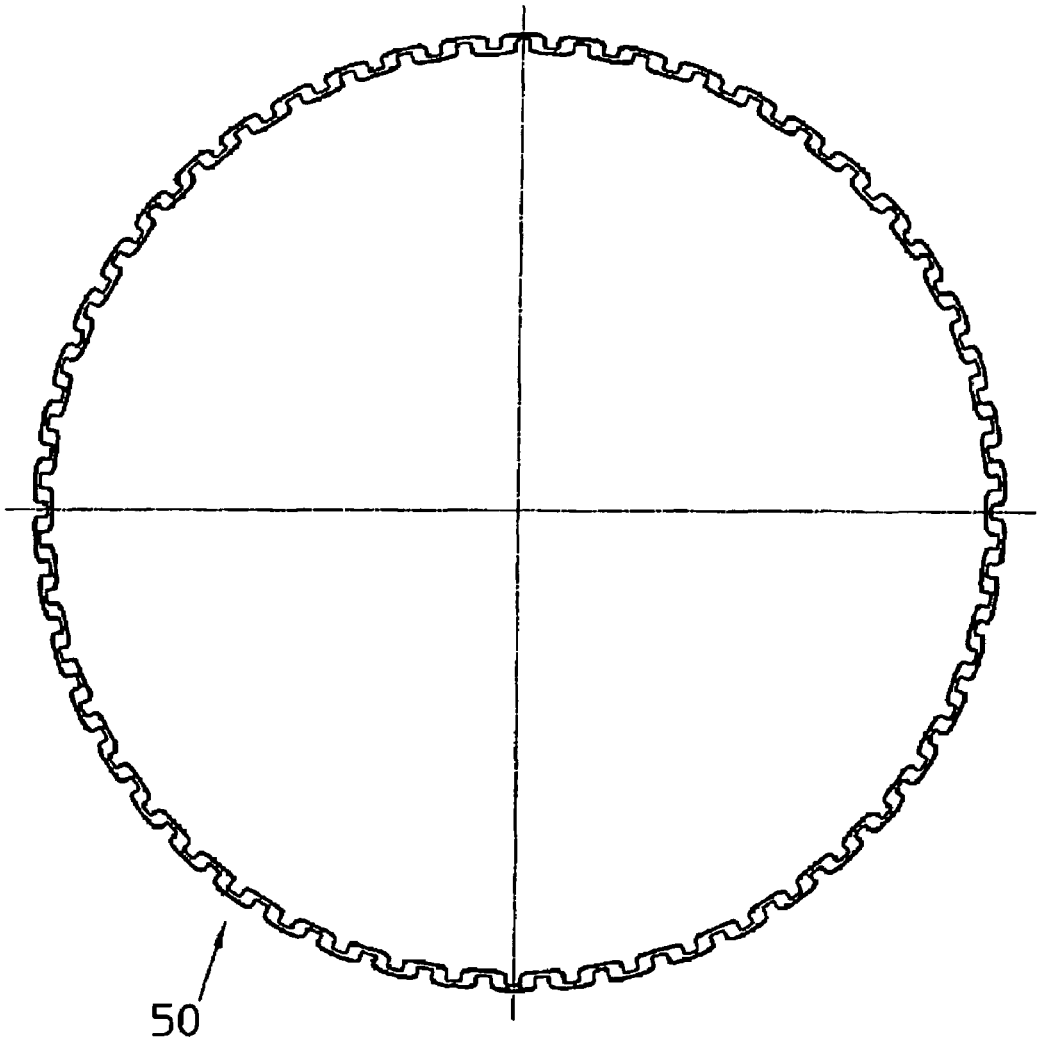
Figure 4B:
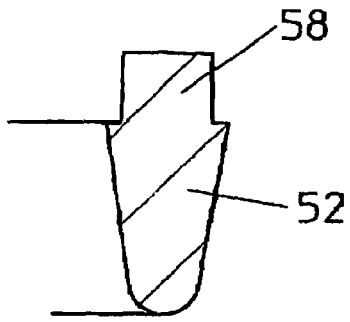
Figure 4A:
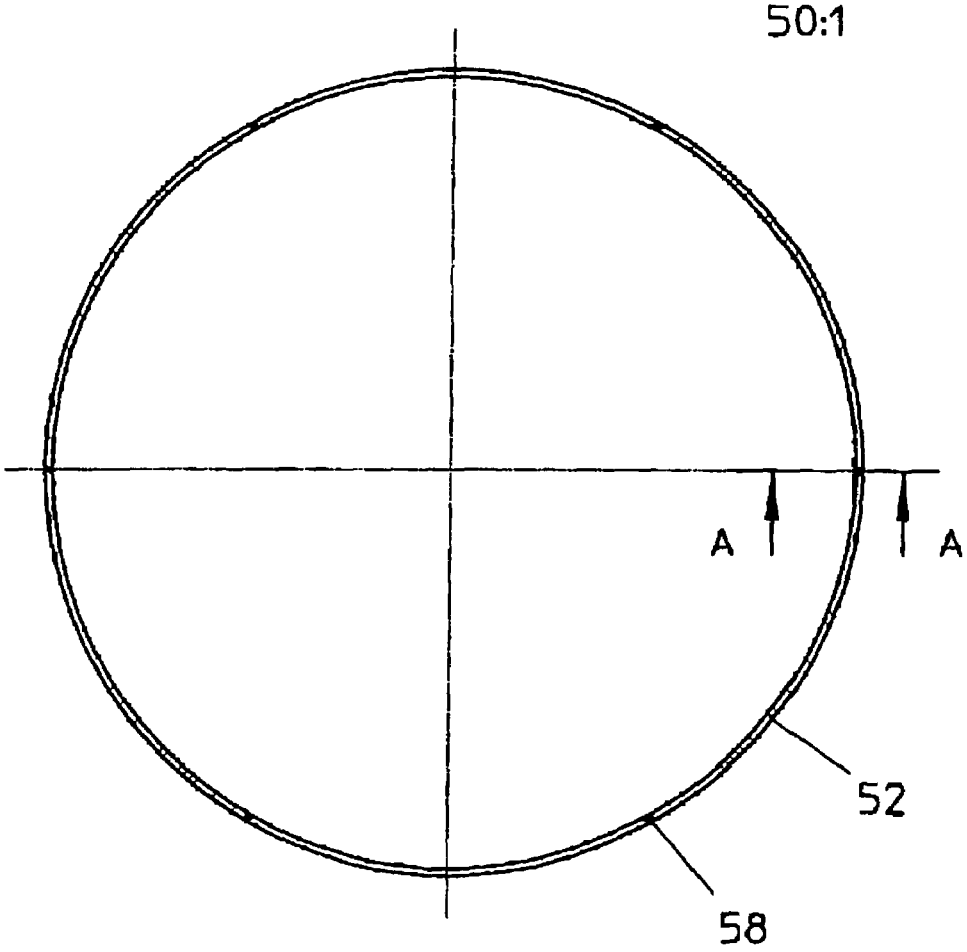

Other features of the invention will emerge from the description which will follow, given with reference to the attached drawing, in which:

FIG. 1 is a simplified view in cross section of the elements of a watch case according to the invention, FIG. 2 shows, on a larger scale, the structure exhibited by the case of FIG. 1 at the interface between the bezel and the middle, without the seal at a and with it at b, and FIGS. 3, 4*a* and 4*b* illustrate details relating to the seal that the case according to the invention comprises.

FIG. 1 depicts, in part, a sealed watch case 10 according to the invention, having a lower face 12, intended to be in contact with the wearer's arm, and an upper face 14 where the means displaying the time are visible. This case essentially comprises:

- a case middle 16 of annular shape delimiting the volume in which the various members of the watch lie,
- a bezel 18 mounted so that it can be turned on the middle 16,
- a case back depicted schematically as 20 and closing the watch case 10 on its lower side 12, and
- a glass 22 fixed in a sealed manner to the bezel 18, closing the watch case on its upper face 14, and thus allowing the display means borne by the movement to be seen.

More specifically, the back 20 is fixed to the middle 16, generally by screwing or by any means known to those skilled in the art, a seal being inserted between them. The middle 16 has a structure arranged in such a way as to allow a watch movement to be fitted. It also comprises a flat surface 24 and a cylindrical surface 26 for positioning a flange 28.

The flange 28 is fixed to the case middle by screws, depicted schematically by their centerlines 30. It positions and guides the bezel 18, thus allowing it to turn on the middle 16.

The glass 22 may be fixed to the bezel 18 by bonding or by insetting with the interposition of a seal, or using any means known to those skilled in the art.

In order to seal the case at its interface between the case middle 16 and the bezel 18, these two components are shaped in such a way as to define an annular chamber 36 exhibiting two lateral walls 36*a* and 36*b* formed by the middle 16 and the bezel 18 respectively, an upper wall 36*c* formed by the bezel 18 and a lower wall 36*d* essentially formed by the case middle 16.

The chamber 36 is connected to the outside of the case 10 by a gap 40.

As can be seen in FIG. 2*b*, the chamber 36 acts as a housing for a seal 42 comprising a ring 44 with two lips 44*a*, advantageously made of polyurethane with a Shore A hardness of the order of 20 to 30, and a compression member 46.

The ring 44 is annular and its cross section has the overall shape of a U. The lower branch of the U constitutes an intermediate part 44*b* connecting the two lips 44*a*. The width of the U, at its base, is less than that of the chamber 36, whereas the lips 44*a*, which constitute the lateral branches of the U, form between them an acute angle of the order of 5° to 15°. At their free end, they have a contact surface intended to bear against the walls of the chamber, leaving the gap 40 free. These contact surfaces for contact between the lips 44*a* and the lateral walls 36*a* and 36*b* of the chamber 36 are continuous, which means that the seal at the interface between the case middle 16 and bezel 18 is ensured.

The intermediate part 44*b* is flat and hugs the lower wall 36*d* of the chamber 36. A space 48 defined between the branches of the U is thus in direct communication with the outside of the watch case 10, via the gap 40.

The compression member 46 is housed inside the space 48. This compression member consists of an annular spring 50 placed directly in contact with the lips 44*a* and of a positioning ring 52 inserted between the spring and the upper wall 36*c* of the chamber 36.

As illustrated in FIG. 3, the annular spring 50 is in the form of a band of more or less constant width forming regular wave forms arranged on either side of a circle of diameter D more or less equal to the mean diameter of the chamber 36. The spring 50 is obtained from a strip of stainless steel that is chemically machined.

The wave forms are bent in a V-shape on either side of the line constituting the diameter D. The angle formed is slightly larger than the angle formed by the lips 44*a* so that, when it is fitted, it forces the free ends of the lips 44*a* against the walls 36*a* and 36*b* of the chamber. This angle typically lies between 10° and 20°. Its vertex is rounded. This configuration means that the spring 50 has great elasticity.

At atmospheric pressure, the pressure applied by the spring 50 to the ring 44 makes it possible to control the torque needed to turn the bezel 18 and ensure contact of the lips 44*a* over the entire perimeter of the walls 36*a* and 36*b*.

The positioning ring 52 depicted in FIGS. 4*a* and 4*b* has the same mean diameter as the ring 44. It is placed in contact with the spring 50, facing the bezel 18, and has positioning studs 58 resting against the bezel 18 so as to keep the spring 50 in contact with the lips.

The studs 58 are of cylindrical shape and have a flat surface intended to be in contact with the bezel. The height of the assembly formed by the ring 52 and by the studs 58 is equal to the distance separating the bezel 18 from the annular spring 50. The latter is thus precisely held in place while the bezel 18 slides over the studs 58 when it is turned.

When the watch is submerged, the chamber 48 is connected to the external surroundings by the gap 40 and, by virtue of the fact that the positioning studs 58 do not occupy the entire chamber 48, this chamber is at the same pressure as the external surroundings. The water then compresses the positioning ring 52 which presses against the seal 42 and firmly presses the lips 44*a* against the walls of the chamber 36. Thus, the higher the external pressure, the more firmly the lips 44*a* are pressed against the walls 36*a* and 36*b* of the chamber. Under these conditions, the friction forces then created between the lips 44*a* and the watch case 10 make any turning of the bezel 18 impossible. The bezel is therefore locked during a dive, and this enhances safety.

In deep water, the diver breathes a gaseous mixture containing helium or hydrogen. These light gases may enter the watch case. As the diver returns towards the surface, the external pressure may decrease more rapidly than the pressure inside the watch case. If there is no valve provided for regulating this overpressure, the glass may be expelled from its housing. With a case according to the invention, such a valve is not needed. This is because, by virtue of the shape of the lips 44*a*, the gas contained inside the case 10 can escape freely.

In other words, the watch case thus produced is perfectly sealed when the external pressure exceeds the internal pressure, and it allows the gas it contains to escape when the internal pressure exceeds the external pressure.

A sealed watch case provided with a rotary bezel the sealing of which is particularly good is thus obtained. Furthermore, this good sealing is not achieved at the expense of the ease with which the rotary bezel can be turned.

The case as described may, of course, be varied in numerous ways without in any way departing from the scope of the invention. Thus, the chamber 36 could have a cross section other than a rectangular one. In addition, the seal could be orientated differently with, for example, the lips in contact with the upper 36*c* and lower 36*d* walls while the intermediate part would be in contact with the lateral wall 36*a* formed on the bezel 18.

The means of assembling the bezel 18 with the case middle 16 could also be modified considerably. The moving interior part could occupy a far greater amount of space so as to allow a maximum amount of information to be displayed and thus offer better conditions for reading this information.

The invention claimed is:

1. A watch case comprising a case middle (16), a bezel (18) mounted so that it can turn on the middle and defining between them an annular chamber (36) and a gap (40) open towards the outside of the case, a glass (22) mounted in sealed fashion on the bezel, a seal (42) inserted between the bezel and the middle and arranged in said chamber (36), characterized in that said seal comprises a ring (44) of annular shape made of a material of the highly elastically deformable type and the cross section of which comprises two lips (44*a*), one bearing against the bezel (18), the other against the case middle (16), and a compression member (46) arranged in said chamber on the side of the gap, inserted between and collaborating with said lips in order to compress them against the bezel and against the case middle, respectively.

2. The watch case as claimed in claim 1, characterized in that said chamber (36) is defined by lateral, upper and lower walls, the lips (44*a*) are connected to one another by an intermediate part (44*b*) and are arranged in such a way as to form an acute angle between them, said lips having, at their free end, a contact surface intended to bear against the walls of said chamber without said gap being filled.

3. The watch case as claimed in claim 2, characterized in that said intermediate part (44*b*) is flat and hugs the lower wall of the chamber (36), said lips bearing via their contact surface against the lateral walls.

4. The watch case as claimed in claim 2, characterized in that the compression member (46) comprises an annular spring (50) placed directly in contact with the lips (44*a*).

5. The watch case as claimed in claim 4, characterized in that the annular spring (50) has regular wave forms distributed on either side of a circle of a diameter more or less equal to the mean diameter of said chamber, said wave forms being bent about the line formed by said circle, the angle of the bend being greater than or equal to the angle formed by said lips.

6. The case as claimed in claim 4, characterized in that said spring is made of stainless steel.

7. The case as claimed in claim 4, characterized in that said compression member comprises, in addition, a positioning ring (52) inserted between said spring and one of the walls of the chamber.

8. The watch case as claimed in claim 7, characterized in that the positioning ring (52) is arranged facing the bezel (18) and comprises positioning studs (58) resting against said bezel in such a way as to keep the intermediate part bearing against a wall of said chamber.

9. The watch case as claimed in claim 3, characterized in that the compression member (46) comprises an annular spring (50) placed directly in contact with the lips (44*a*).

10. The case as claimed in claim 5, characterized in that said spring is made of stainless steel.

11. The case as claimed in claim 9, characterized in that said spring is made of stainless steel.

12. The case as claimed in claim 5, characterized in that said compression member comprises, in addition, a positioning ring (52) inserted between said spring and one of the walls of the chamber.

13. The case as claimed in claim 6, characterized in that said compression member comprises, in addition, a positioning ring (52) inserted between said spring and one of the walls of the chamber.

14. The case as claimed in claim 9, characterized in that said compression member comprises, in addition, a positioning ring (52) inserted between said spring and one of the walls of the chamber.

15. The case as claimed in claim 10, characterized in that said compression member comprises, in addition, a positioning ring (52) inserted between said spring and one of the walls of the chamber.

16. The case as claimed in claim 11, characterized in that said compression member comprises, in addition, a positioning ring (52) inserted between said spring and one of the walls of the chamber.

* * * * *